United States Patent [19]

Ekström

[11] 4,407,349

[45] Oct. 4, 1983

[54] SHIELDING WINDOWS

[75] Inventor: Lars A. Ekström, Djursholm, Sweden

[73] Assignee: Raywall Kommanditbolag, Marsta, Sweden

[21] Appl. No.: 249,088

[22] Filed: Mar. 30, 1981

[51] Int. Cl.[3] ..... A47H 1/00; E06B 3/32

[52] U.S. Cl. ..... 160/98; 160/265; 160/239

[58] Field of Search ..... 160/108, 120, 107, 265, 160/89, 99, 98, 239; 52/172, 173, 171

[56] References Cited

U.S. PATENT DOCUMENTS

| | | | |
|---|---|---|---|
| 1,713,989 | 5/1929 | Warnick | 160/120 X |
| 1,751,735 | 3/1930 | Hicinbothem | 160/265 |
| 1,772,892 | 8/1930 | Green | 160/265 X |
| 1,944,454 | 1/1934 | Park | 160/265 |
| 1.983,617 | 12/1934 | Ladon | 160/DIG. 7 |
| 2,415,222 | 2/1947 | Spencer | 160/107 |
| 3,211,264 | 10/1965 | Streeter | 160/107 |
| 3,629,980 | 12/1971 | Hordis | 52/1 |

*Primary Examiner*—Peter M. Caun

*Assistant Examiner*—Cherney S. Lieberman

*Attorney, Agent, or Firm*—Holman & Stern

[57] ABSTRACT

Improvement in shielding windows having at least two panes, which form an enclosed space by means of a frame, in which space a shield is arranged to adjustably shield the window opening completely or partly. The shield is extendable and retractable out of and in to a storing position in the space, one end of said shield being fixed to a storing device and either the other end or said storing device being fixed to a piston disposed between the panes. The piston is displacable along the panes and corresponds to the cross-section of the space. Either the storing device or the other end is fixed to the frame so that displacement of the piston will cause a relative displacement of the two ends of the shield (extension or retraction). A pressurized air conduit opens into the space on one side of the piston and a second conduit opens into the space on the other side of the piston. A valve is provided for supplying pressurized air to one of the conduits and opening the other conduit for returning of air and vice versa so that the piston can be displaced in both directions by the air pressure.

6 Claims, 5 Drawing Figures

FIG.2
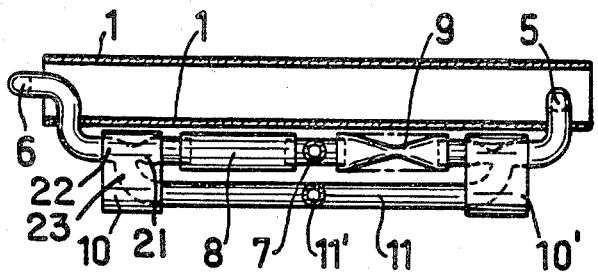
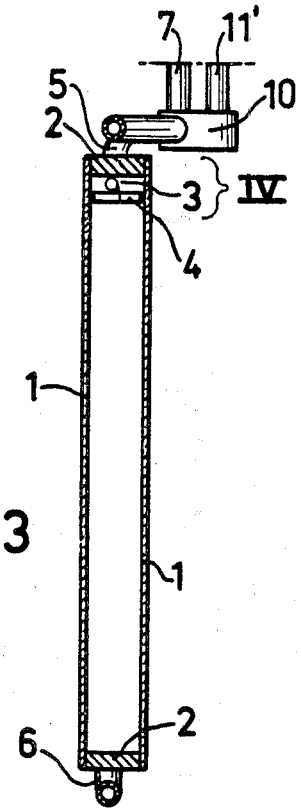
FIG.3
FIG.4
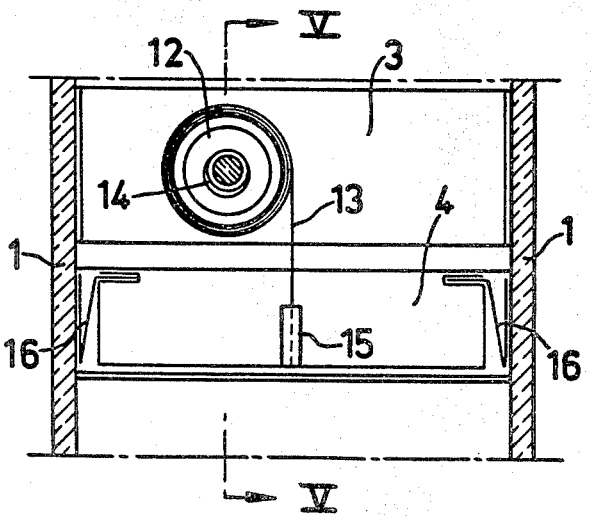
FIG.5
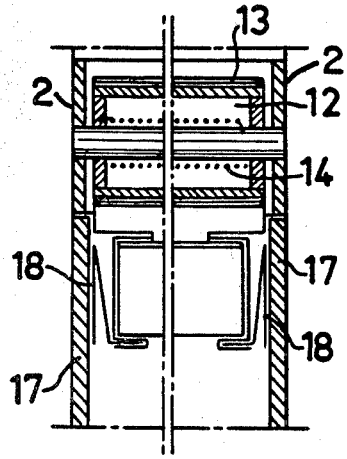

SHIELDING WINDOWS

FIELD OF THE INVENTION

This invention relates to improvement in shielding windows having at least two panes, which between them form a tight space by means of a frame, in which space a shielding means is arranged to adjustably shield the window opening completely or partly.

BRIEF SUMMARY OF THE INVENTION

The object of the invention is to provide a shielding means which adjustably can shield any desirable part of the window opening. Another object of the invention is a driving device for adjusting the shielding means in a desired position.

BRIEF DESCRIPTION OF THE DRAWINGS

The invention is illustrated more or less diagramatically in the accompanying drawings, wherein FIG. 2 is a top view of the window according to FIG. 1, FIG. 3 is a longitudinal cross-sectional view taken along line III—III of FIG. 2 is a top view of the window according to FIG. 1.

FIG. 4 is an enlarged partial cross sectional view of the section in FIG. 3 substantially included in bracket IV, and FIG. 5 is a cross sectional view taken along line V—V of FIG. 4 wherein only the two end parts of the cross sectional view are shown.

DESCRIPTION OF THE PREFERRED EMBODIMENTS

Figure 1:
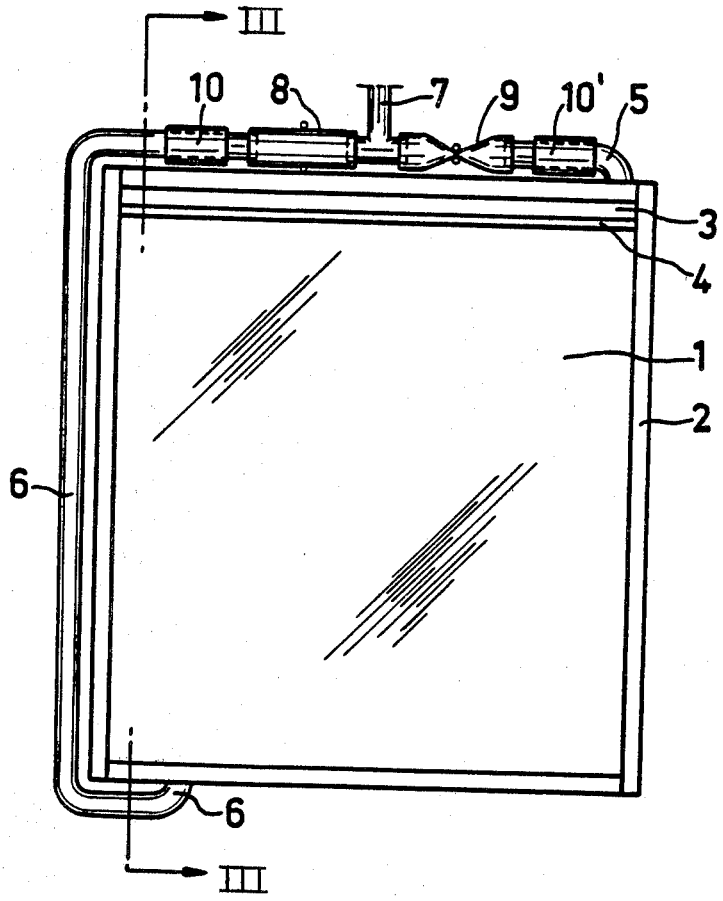
FIG. 1 is a front elevational view of a window showing the shielding means and its driving device.

FIGS. 1, 2 and 3 show two panes 1 mounted in a frame 2 with a distance between them so that a space is formed which is closed by being surrounded by the frame 2. In the upper end of the space is diagramatically shown a cassette 3, in which the shielding means is enclosed. The shielding means will be described more in detail hereinafter, but it consists of an opaque foil, which is rolled on a roller. The foil is unrolled against the force of a spring. A piston 4 is moved upwards and downwards within the space between the panes and the free end of the foil is fastened to the piston so that when the piston is moved downwardly the foil is unrolled of the bar whereby the foil will shield the window opening completely (the piston 4 being in the bottom of the window) or partly depending on the displacement of the piston 4.

The manner of displacing the piston 4 and thereby adjusting the foil will be described in connection with FIGS. 1, 2 and 3. It can easily be understood, that if the air pressure above the piston is increased and the air pressure under the piston is decreased, the piston will move downwardly. The air pressure on both sides of the piston are adjusted by means of a piping system which includes an inlet 7 which is branched in two directions. A valve 8 is arranged in the left branch in FIG. 1 and valve is arranged in the right branch in FIG. 1. From the valve 8 a pipe 6 leads along the side of the window and to the bottom of the window where it opens into the space between the panes below piston 4. From the valve 9 a pipe 5 leads to the upper end of the window where it opens into the space above the piston 4. The pipe 6 also includes a safety valve 10 and pipe 5 includes a second safety valve 10'. As can be seen from FIG. 2, there is a conduit 11 which is parallel to the valves 8 and 9 and is connected at its ends to the pipe 6 and the pipe 5 via the safety valves 10 and 10'. The conduit 11 has an opening 11'. The openings 7 and 11' are connected to a source of air (not shown), whereby the air pressure to the opening 7 can be raised by a pumping means (not shown). Thus, the air entering the opening 7 has a slightly higher pressure than the air passing out of the opening 11'.

When air of a certain raised pressure is passed into the opening 7, the valve 9 is closed, which means that the air will pass through the valve 8 and through the pipe 6 down to the bottom end of the space between the panes below piston 4. The air above the piston 4 will pass out of that space through the pipe 5 and because the valve means 9 is closed, the air will pass through safety valve 10' and pipe 11 and out of the opening 11' and back to the supply of air. This means that the air pressure above the piston 4 is lower than the air pressure below the piston and thus the piston 4 will be raised to its uppermost position shown in FIG. 1.

To cause the piston 4 to move downwardly and thereby unroll the foil from the bar, the valve 8 is closed and the valve 9 is opened, which causes the air to pass from the inlet 7 to the space above the piston 4 via the pipe 5. The air under the piston 4 will be let out through the pipe 6, valve 10, pipe 11 and the outlet 11'. Thus, by opening and closing of the two valve 8 and 9, the piston 4 is moved downwardly or upwardly depending on which side of the piston the pressure is highest. The air is forced to the inlet 7 by a pump (not shown), which means that when the pump is stopped, the air pressure on both sides of the piston 4 will be equal. There is a certain friction between the piston 4 and the inner sides of the panes 1 and this friction can be so adapted that it overcomes the force of the spring which tends to roll the bar in one direction. This means that when the air pressure on both sides of the piston is equal, the piston will keep the position set when the pump is stopped. If, thus, the piston 4 has been set in a position half way down in the window, the foil has been drawn half-way down and thus half of the window is shielded. It is easy to understand that the piston can be set in any position, whereby the window can be shielded to any desired extent.

From FIG. 4 the shielding means can be seen. It consists of a roller 12 which rotates in bearings at its ends mounted in the frame 2. A spring 14 of the kind used in ordinary roller blinds is placed within the roller and when the roller is rotating in the clock-wise direction in FIG. 4 the spring will be tightened. The free end of the foil 13 is fastened in a holder 15 on the piston 4 as mentioned above. The piston 4 consists of a frame having the same form as the cross section through the window. The sides of the piston 4 has tightening means 16 in the form of lips which have some elasticity so that they abut on the inner side of the panes 1. The lips may have a soft material on the side which is abutting the panes. As can be seen from FIG. 5, the piston 4 also has tightening means 18 in form of lips, which are abutting the inner sides of the frame 2. By the lips 16 and 18 the piston 4 will slide with a certain friction against the two panes 1 and the sides of frame 2. In FIG. 5 it is shown that the inner sides of the frame 2 have sliding ways 17 for giving a better fitting between the piston 4 and the frame.

It is important that the pressure in the space between the panes is not raised too much because if so, the panes may crack. On the other hand, the pressure at the inlet 7 must be relatively high, say 50 mm of water column, in order to make sure that the pressure reaching the piston is high enough to move the piston. Hence this pressure will be established within the space and when the piston has reached its end position the pressure will rise still more if the pumping means is not stopped at once. The object of the safety valve 10 is to automatically adjust the pressure so it will not rise over a certain value, say 50 mm of water column. The safety valve consists of an inlet having a narrow part 21, an outlet 22 leading to the pipe 6 and a branch conduit 23 leading to the pipe 11. The outlet 22 and narrow part 21 form a diffuser. Depending on the dimensions of the diffuser, i.e. the diameter of the narrow part 21 in relation to the diameter of the outlet 22 and branch 23 certain relations between the possible air pressures in the three parts 21, 22 and 23 will be established. Thus, these dimensions can be chosen so that when the air pressure in the pipe 6 is raised to 50 mm of water, the air being forced by the pump through the inlet 7 and through the narrow part 21 will be diverted into the pipe 23 and will be passed into the pipe 11 and out through the outlet 11' and back to the reservoir. Thus, the air pressure in the pipe 6 and accordingly also in the space between the panes will not be increased further even if the pump is still working. The safety valve 10' joined to the pipe 5 works in the same way. Thus, the space between the panes always are opened to the reservoir, which preferably has an expansion space so that no counter-pressure can be established in outlet 11'.

In the above described embodiment has been shown one foil rolled on a roller. It is quite obvious after knowledge of the invention that a second or a third foil can be rolled on the same roller or on separate parallel rollers. Also, it has been described that the shielding means consists of a foil but any other shielding means, which is capable of being extensible and retractable, can be used. Alternatively, the roller can be mounted in bearings fixed to the piston, with the free end of the foil being fastened to the upper frame part in any suitable manner.

I claim:

1. A window shield for multi-pane windows comprising a window frame, at least two window panes sealingly mounted at their edges in spaced relationship in said frame to provide a sealed space between said panes and said frame, a piston means disposed within said space in sliding engagement with the inner sides of said panes and oppositely disposed sections of said frame so that said piston means is movable through substantially all of said space, said piston means having a cross-section corresponding to the cross-section of said space, an extendable and retractable shield member within said space mounted at one end to said frame and at the other end to said piston so that said movement of said piston through said space moves said shield member between its retracted position and its extended position, said retracted position being located adjacent one end of the path of movement of said piston, storage means to store said shield in the retracted position, a first conduit connected to said space on one side of said piston means, a second conduit connected to said space on the other side of said piston means, valve means operably connected to said conduits to selectively direct pressurized air to one side of said piston means and relieve the pressure on the other side of said piston means to operate said piston means to selectively extend or retract said shield means, and a source of pressurized air operably connected to said valve means.

2. A window shield as claimed in claim 1 wherein said shield member comprises a foil and said storage means comprises a roller rotatably mounted in said space and a spring means operably connected to said roller to resiliently urge said roller rotatably in one direction, said foil being connected at one end to said roller so that it is rolled onto said roller in said one direction in the retracted position and unrolled from said roller when drawn by said piston means to the extended position against the force of said spring means.

3. A window shield as claimed in claim 2 wherein said sliding engagement of said piston with said inner sides of the panes and frame produces a frictional force which is greater than the maximum force of said spring means so that said piston will be retained in any position of shielding when the pressure on opposite sides of said piston is substantially equal.

4. A window shield as claimed in claim 1 and further comprising a safety valve means operably connected in each conduit to by-pass said air pressure when the pressure in said space on either side of the piston reaches a predetermined value.

5. A window shield as claimed in claim 4 wherein each said safety valve means comprises a three way valve having an inlet connected to said source of air pressure, a reduced duct section connected to said inlet, an outlet connected to said reduced section and said respective conduit, and a return duct connected at one end between said reduced section and said outlet downstream of said reduced section and at the other end to a return line leading to a low pressure return at said source of air pressure, the dimensions of said inlet, reduced section and outlet being predetermined so that these parts form a diffuser which functions to by-pass said air pressure to said return duct when the pressure in said spaces reaches a predetermined value.

6. A window shield as claimed in claim 2 wherein said roller is rotatably mounted at its ends in said frame and the free end of said foil is attached to said piston means.

* * * * *

UNITED STATES PATENT AND TRADEMARK OFFICE

CERTIFICATE OF CORRECTION

PATENT NO. : 4,407,349

DATED : October 4, 1983

INVENTOR(S) : Lars A. Ekström

It is certified that error appears in the above-identified patent and that said Letters Patent is hereby corrected as shown below:

Column 1, line 22, after "device," should read -- with the outlet pipes being omitted to show other parts, --.

Signed and Sealed this

*Third* Day of *April 1984*

[SEAL]

*Attest:*

GERALD J. MOSSINGHOFF

*Attesting Officer*

*Commissioner of Patents and Trademarks*